US011636868B2

(12) United States Patent
He

(10) Patent No.: US 11,636,868 B2
(45) Date of Patent: Apr. 25, 2023

(54) AUDIO PROCESSING METHOD FOR PERFORMING AUDIO PASS-THROUGH AND RELATED APPARATUS

(71) Applicant: Realtek Semiconductor Corp., HsinChu (TW)

(72) Inventor: Wei-Hung He, HsinChu (TW)

(73) Assignee: Realtek Semiconductor Corp., HsinChu (TW)

( * ) Notice: Subject to any disclaimer, the term of this patent is extended or adjusted under 35 U.S.C. 154(b) by 161 days.

(21) Appl. No.: 17/164,794

(22) Filed: Feb. 1, 2021

(65) Prior Publication Data

US 2022/0068291 A1 Mar. 3, 2022

(30) Foreign Application Priority Data

Sep. 1, 2020 (TW) ..... 109129899

(51) Int. Cl.
*G10L 21/0232* (2013.01)
*G10L 19/008* (2013.01)
*G10L 21/0224* (2013.01)

(52) U.S. Cl.
CPC ..... *G10L 21/0232* (2013.01); *G10L 19/008* (2013.01); *G10L 21/0224* (2013.01)

(58) Field of Classification Search
CPC ..... G10L 21/0203; G10L 21/0224; G10L 21/0208; G10L 19/008
See application file for complete search history.

(56) References Cited

U.S. PATENT DOCUMENTS 5,416,847 A 5/1995 Boze
6,098,038 A 8/2000 Hermansky
2006/0269016 A1* 11/2006 Long ..... H04L 5/0048 375/346
2006/0277238 A1* 12/2006 Heeb ..... H03H 17/0628 708/490
2013/0302041 A1* 11/2013 Matsui ..... H04B 10/6161 398/208
2014/0219319 A1* 8/2014 Chen ..... H04L 27/0014 375/134
2015/0213811 A1* 7/2015 Elko ..... H04R 3/005 381/92
2015/0215700 A1* 7/2015 Sun ..... H04R 3/002 381/94.2
2018/0286462 A1* 10/2018 Becherer ..... G11B 27/036
(Continued)

OTHER PUBLICATIONS

Philipos C. Loizou, "Speech enhancement theory and practice", pp. 93-97, Chapter 5.1, 2013.

(Continued)

*Primary Examiner* — Paras D Shah
*Assistant Examiner* — Paul J. Mueller
(74) *Attorney, Agent, or Firm* — Winston Hsu

(57) ABSTRACT

An audio processing method includes: converting a time-domain audio signal into a frequency-domain audio signal; determining a noise reduction gain according to the frequency-domain audio signal; and selecting at least one set of time-domain filter coefficients from a plurality sets of time-domain filter coefficients according to the noise reduction gain; configuring a time-domain filter according to the at least one selected set of time-domain filter coefficients, and filtering the time-domain audio signal with the time-domain filter.

12 Claims, 5 Drawing Sheets

(56) References Cited

U.S. PATENT DOCUMENTS

| | | | | |
|---|---|---|---|---|
| 2019/0020966 | A1* | 1/2019 | Seldess | H04S 7/303 |
| 2021/0020158 | A1* | 1/2021 | Zhou | G10K 11/17854 |

OTHER PUBLICATIONS

Martin, "Noise power spectral density estimation based on optimal smoothing and minimum statistics", IEEE Transactions on Speech and Audio Processing, vol. 9, No. 5, Jul. 2001.

Malah, "Speech enhancement using a minimum mean-square error log-spectral amplitude estimator", IEEE Transactions on Acoustics Speech and Signal Processing, May 1985.

Kalinichenko, "Smooth and safe parameter interpolation of biquadratic filters in audio applications", Proc. of the 9th Int. Conference on Digital Audio Effects (DAFx-06), Montreal, Canada, Sep. 18-20, 2006.

* cited by examiner

AUDIO PROCESSING METHOD FOR PERFORMING AUDIO PASS-THROUGH AND RELATED APPARATUS

BACKGROUND OF THE INVENTION

1. Field of the Invention

The present invention relates to audio devices, and more particularly to, audio processing methods and related apparatus for use in headphone systems to realize low-latency audio pass-through technology.

2. Description of the Prior Art

In-ear headphones or closed back headphones usually have a certain degree of sound insulation effect. If it is desired to allow users to hear sounds from external environments, while using this type of headphones to listen to music, microphones are usually used to pick up the sounds from the external environments, and speaker units of the headphones are accordingly used to reproduce the sounds that are received by the microphone. Such technology is called audio pass-through (APT).

Generally, the audio pass-through pursues a natural sense of hearing. While preserving the sound from the environments, it is also demanded that noise in the environmental sound can be removed, such as sound of air conditioners, sound of winds, or noise from the microphone. However, during the processing of noise reduction, a certain degree of latency from digital/analog conversion, time domain/frequency domain conversion, and digital signal processing will be introduced. In audio pass-through processing, environmental sounds heard by the user partially comes from sound waves penetrating the sound insulation layer of the headphone, while partially comes from sound waves reproduced by the speaker unit of the headphone that are recorded by the microphone and processed by noise reduction processing. Therefore, if the latency of the noise reduction processing is too severe, the sound waves from different sources will be inevitably out of sync, such that the user may hear echoes.

Please refer to FIG. 1, which illustrates a schematic diagram of an audio processing device for implementation of audio pass-through technology in the prior art. As shown in the FIG. 1, an analog audio signal recorded by an audio pickup device 10 (such as a microphone) is first converted into a time-domain digital audio signal x[t] by an analog-to-digital converter 11. Through a Fourier transform unit 12, the time-domain digital audio signal x[t] is transformed to a frequency-domain audio signal X[f, t]. Accordingly, a noise floor estimation unit 13 and a noise reduction gain calculation unit 14 generate a corresponding noise reduction gain G[f, t] based on the frequency-domain audio signal X[f, t]. A noise reduction processing unit 15 performs a noise reduction processing on the frequency-domain audio signal X[f, t] according to the noise reduction gain G[f, t], thereby producing a frequency-domain audio signal Y[f, t]. Through an inverse Fourier transform unit 16, the frequency-domain audio signal Y[f, t] is transformed back to the time domain, thereby obtaining a time-domain audio signal y[t]. The time-domain audio signal y[t] is combined with an audio signal z[t] that the user intends to listen to (such as, music, voice, etc.) through a summation unit 17. The result of summation is converted into an analog audio signal through a digital-to-analog converter 18 and further used to drive a speaker unit, which transforming electronic signals into sound waves for the users to listen to.

In such architecture, assuming that a sampling frequency of the analog-to-digital converter 11 is fs and a size of the Fourier transform unit 12 is N, a processed signal will have a latency of at least N/fs relative to the original sound from the external environment. In a typical case where N=128 and fs=16 KHz, there will be a latency of at least 8 ms. Such degree of latency will definitely lead to a poor user experience.

SUMMARY OF THE INVENTION

In order to solve the above problems, it is one object of the present invention to provide audio processing methods and apparatus for implementing audio pass-through technology. In audio processing architecture proposed by the present invention, noise reduction processing is mainly performed in time domain through a time-domain filter. Compared with the conventional art, the latency caused by the conversion between time domain and frequency domain can be effectively reduced. Furthermore, once the present invention performs noise estimation and analysis in the frequency domain, specific time-domain filter settings are thus selected from predetermined time-domain filter coefficients. The present invention avoids the use of frequency-domain filter coefficients, which may result in potential latency that are caused by the conversion between the frequency domain and the time domain. In view of this, the audio processing methods and apparatus of the present invention can achieve audio pass-through with low latency and good noise reduction effect.

According to one embodiment, an audio processing method is provided. The audio processing method comprises: converting a time-domain audio signal into a frequency-domain audio signal; determining a noise reduction gain according to the frequency-domain audio signal; selecting at least one set of time-domain filter coefficients from a plurality sets of predetermined time-domain filter coefficients according to the noise reduction gain; and configuring a time-domain filter according to the at least one selected set of time-domain filter coefficients, and filtering the time-domain audio signal with the time-domain filter.

According to one embodiment, an audio processing apparatus is provided. The audio processing apparatus comprises: a Fourier transform unit, a noise analysis unit, a filter coefficient storage unit, a filter coefficient selection unit and a time-domain filter. The Fourier transform unit is arranged to convert a time-domain audio signal into a frequency-domain audio signal. The noise analysis unit is coupled to the Fourier transform unit, and arranged to determine a noise reduction gain according to the frequency-domain audio signal. The filter coefficient storage unit is arranged to store a plurality set of predetermined time-domain filter coefficients. The filter coefficient selection unit is coupled to the noise analysis unit and the filter coefficient storage unit, and arranged to select at least one set of time-domain filter coefficients from the plurality sets of predetermined time-domain filter coefficients according to the noise reduction gain. The time-domain filter is coupled to the filter coefficient selection unit, controllable by the at least one selected set of time-domain filter coefficients, and arranged to filter the time-domain audio signal.

These and other objectives of the present invention will no doubt become obvious to those of ordinary skill in the art after reading the following detailed description of the preferred embodiment that is illustrated in the various figures and drawings.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Reference throughout this specification to "one embodiment" or "an embodiment" means that a particular feature, structure or characteristic described in connection with the embodiment or example is included in at least one embodiment of the present embodiments. Thus, appearances of the phrases "in one embodiment" or "in an embodiment" in various places throughout this specification are not necessarily all referring to the same embodiment. Furthermore, the particular features, structures or characteristics may be combined in any suitable combinations and/or sub-combinations in one or more embodiments.

Figure 1:
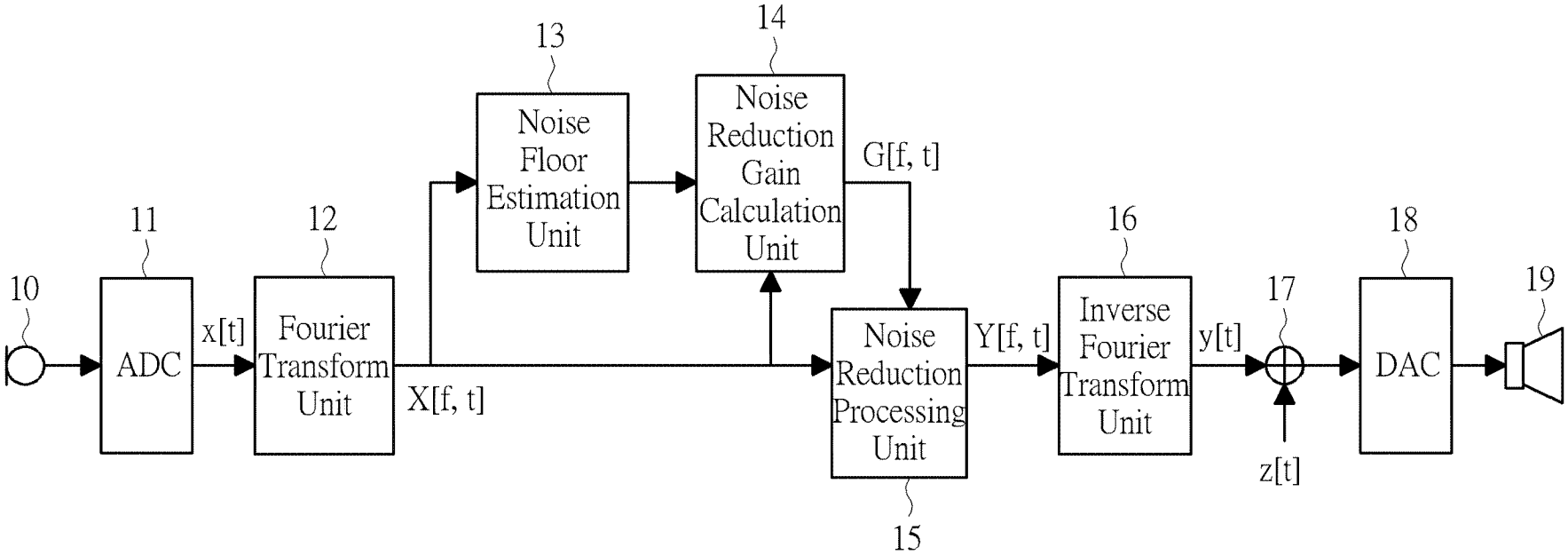
FIG. 1 PRIOR ART
FIG. 1 illustrates a schematic diagram of a conventional audio processing device.
Figure 2:
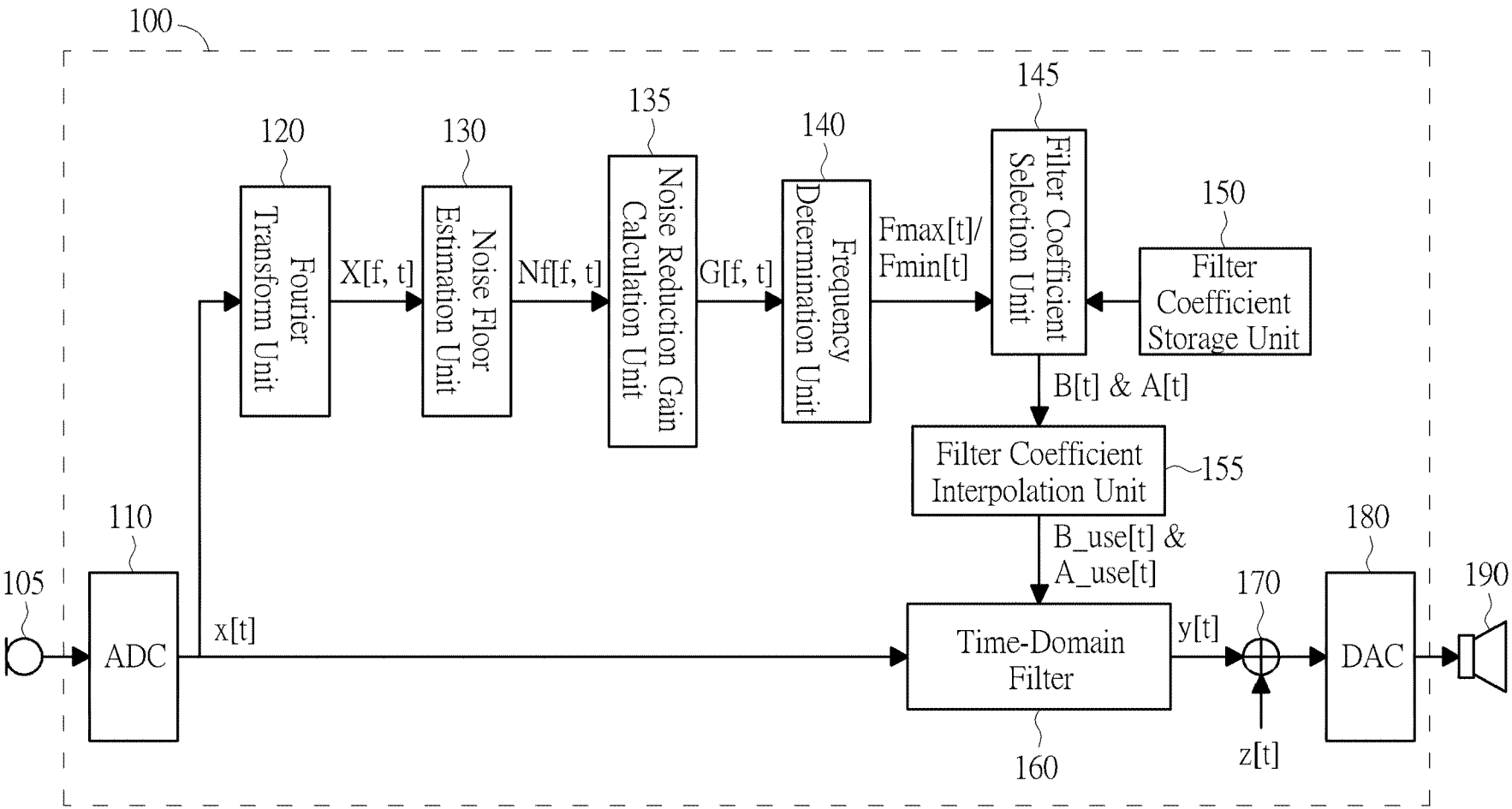
FIG. 2 illustrates a diagram of an audio processing device according to one embodiment of the present invention.

Please refer to FIG. 2, which illustrates a schematic diagram of an audio processing apparatus according to one embodiment of the present invention. As shown by FIG. 2, an audio processing apparatus 100 of the present invention includes: an analog-to-digital converter (ADC) 110, a Fourier transform unit 120, a noise floor estimation unit 130, a gain calculation unit 135, a frequency determination unit 140, a filter coefficient selection unit 145, a filter coefficient storage unit 150, a time-domain filter 160, a summation unit 170, and a digital-to-analog converter (DAC) 180.

The ADC 110 is used to convert an analog audio signal, which is produced by an external audio pickup device 10 (such as a microphone) picking up external environmental sounds, into a digital time-domain audio signal x[t]. The Fourier transform unit 120 is used to transform the time-domain audio signal x[t] into a frequency-domain audio signal X[f, t]. In one embodiment, the Fourier transform unit 120 generates the frequency-domain audio signal X[f, t] by performing short-time Fourier Transform (STFT). The noise floor estimation unit 130 is used to estimate a noise floor of the frequency-domain audio signal X[f, t] to obtain a noise floor Nf[f, t]. According to the noise floor Nf[f, t], the gain calculation unit 135 calculates a noise reduction gain G[f, t] for reducing noises. Specifically, the noise floor estimation unit 130 and the gain calculation unit 135 may estimate the noise floor Nf[f, t] and the noise reduction gain G[f, t] according to various appropriate algorithms.

Figure 3:
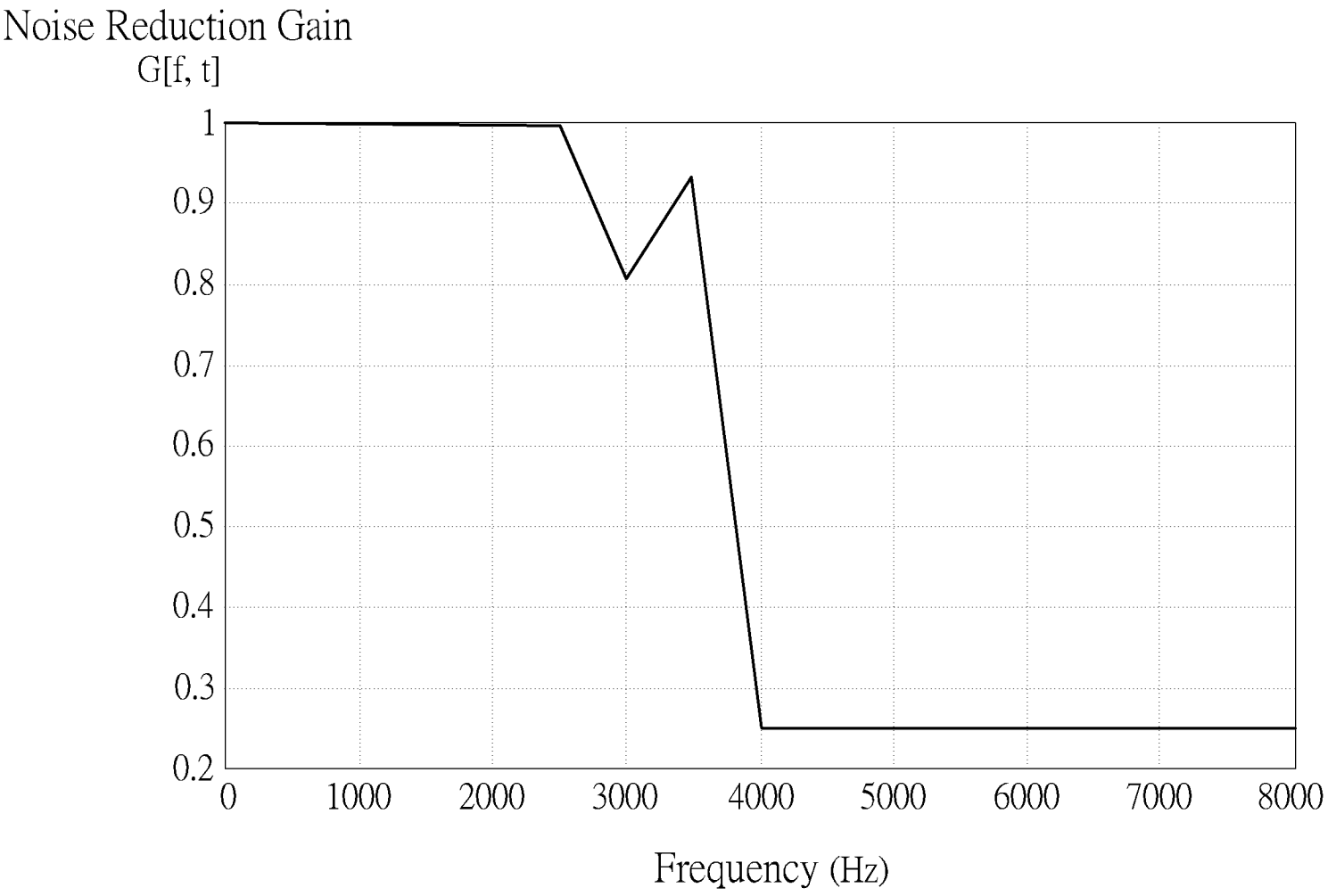
FIG. 3 illustrates a frequency response of a noise reduction gain.

According to the noise reduction gain G[f, t] calculated by the gain calculation unit 135, the frequency determination unit 140 will calculate one or more frequency parameters, and the filter coefficient selection unit 145 will select filter coefficients accordingly. Please refer to FIG. 3, which represents the noise reduction gain G[f, t] at time to, namely the noise reduction gain G[f, t0]. At this time, the frequency determination unit 140 finds a maximum frequency Fmax according to the noise reduction gain G[f, t0]. The maximum frequency Fmax is the frequency when the noise reduction gain G[f, t0] is greater than a certain threshold value. Taking FIG. 3 as an example, if the threshold value is set at 0.9, the frequency determination unit 140 will determine that the maximum frequency Fmax is 3500 Hz. In another embodiment, the maximum frequency Fmax would be calculated by performing a weighted average calculation on a maximum frequency Fmax(t0−1) that is determined at a previous time point and a maximum frequency Fmax(t0) that is determined at a current time point:

$$Fmax'(t0)=Fmax(t0-1)*K+Fmax(t0)*(1-K)$$

Thus, an adjusted maximum frequency Fmax' (t0) is obtained, and the frequency determination unit 140 provides this frequency as the maximum frequency Fmax to the filter coefficient selection unit 145. In one embodiment, the frequency determining unit 140 may use a fixed offset L to adjust the maximum frequency Fmax(t0), or further adjust the adjusted maximum frequency Fmax'(t0):

$$Fmax''(t0)=Fmax'(t0)+L$$

Or $$Fmax''(t0)=Fmax(t0)+L$$

In this way, the adjusted maximum frequency Fmax' (t0) can be obtained, which will be served as the maximum frequency Fmax and then provided to the filter coefficient selection unit 145. According to the frequency parameters provided by the frequency determination unit 140, the filter coefficient selection unit 145 selects an appropriate set of time-domain filter coefficients from the multiple sets of predetermined time-domain filter coefficients stored in the filter coefficient storage unit 150. Specifically, the multiple sets of filter coefficients stored in the filter coefficient storage unit 150 are coefficients combinations corresponding to different filter characteristics, covering different bandwidths. More particular, these sets of time-domain filter coefficients having cutoff frequencies fc distributed between 0 and fs/2 (fs is the sampling frequency of the system), for example, fc=500 Hz, 1000 Hz . . . , or 7500 Hz. Moreover, the filter coefficient selection unit 145 will select a set of time-domain filter coefficients whose cut-off frequency fc is closest to the maximum frequency Fmax. Accordingly, the selected set of time-domain filter coefficients will be used to configure the time-domain filter 160.

In the above embodiments, only audio processing methods for handling high-frequency noise are mentioned. However, this is not a limitation of the present invention. According to various embodiments, the frequency determination unit 140 and the types of filter coefficients stored in the filter coefficient storage unit 150 can be re-designed, thereby to eliminate high-frequency and low-frequency noises at the same time. For example, the plurality sets of time-domain filter coefficients stored in the filter coefficient storage unit 150 may include multiple sets of time-domain filter coefficients having low-pass characteristics, which correspond to a cut-off frequency fc_low, and multiple sets of time-domain filter coefficients having high-pass characteristics, which correspond to a cut-off frequency fc_high.

On the other hand, the frequency determination unit 140 uses the noise reduction gain G[f, t0] to find a maximum frequency Fmax(t0) that allows G[Fmax, t0] to be greater than a certain threshold value, and find a minimum frequency Fmin(t0) that allows G[Fmin, t0] to be greater than a certain threshold value. In addition, the frequency determination unit 140 can perform the above-mentioned weighted average calculation or offset shifting processing on the maximum frequency Fmax(t0) and the minimum frequency Fmin(t0), so as to output adjusted maximum frequency Fmax" (t0) or Fmax' (t0) as well as adjusted minimum frequency Fmin" (t0) or Fmin' (t0) to the filter coefficient selection unit 145. After that, the filter coefficient selection unit 145 finds a set of time-domain filter coefficients from the multiple sets of time-domain filter coefficients having high-pass characteristics, whose cut-off frequency fc_high is closest to Fmin" (t0) or Fmin'. In addition, the filter coefficient selection unit 145 also finds a set of time-domain filter coefficients from the multiple sets of time-domain filter coefficients having low-pass characteristics, whose cut-off frequency fc_low is closest to Fmax" (t0) or Fmax' (t0). As such, the sets of time-domain filter coefficients that can realize a band-pass filter are obtained and will be used in configuring the time-domain filter 160 in the following process.

In one embodiment, in order to reduce the latency as much as possible, the predetermined time-domain filter coefficients and the time-domain filter 160 can implement a minimum phase filter, and the type of the time-domain filter 160 can be high-shelving filter or low-shelving filter. In addition, the time-domain filter 160 may be an infinite impulse response (IIR) or a finite impulse response (FIR) filter. In one embodiment, each set of time-domain filter coefficients may include: cut-off frequency fc, sampling frequency fs, amplitude A, and quality factor Q.

Furthermore, through the following conversion equations:

$$\cos_w0=\cos(2*pi*(fc/fs));$$

$$\sin_w0=\sin(2*pi*(fc/fs));$$

$$\alpha=\sin_w0/2*\mathrm{sqrt}((A+1/A)*(1/Q-1)+2);$$

$$a0=((A+1)-(A-1)*\cos_w0+2*\mathrm{sqrt}(A)*\alpha);$$

$$b0=(A*((A+1)+(A-1)*\cos_w0+2*\mathrm{sqrt}(A)*\alpha))/a0;$$

$$b1=(-2*A*((A-1)+(A+1)*\cos_w0))/a0;$$

$$b2=(A*((A+1)+(A-1)*\cos_w0-2*\mathrm{sqrt}(A)*\alpha))/a0;$$

$$a1=2*((A-1)-(A+1)*\cos_w0)/a0;$$

$$a2=((A+1)-(A-1)*\cos_w0-2*\mathrm{sqrt}(A)*\alpha)/a0;$$

A transfer function of the time-domain filter 160 can be obtained:

$$H(z)=(b0+b1*z\hat{}-1+b2*z\hat{}-2)/(1+a1*z\hat{}-1+a2*z\hat{}-2)$$

Figure 4:
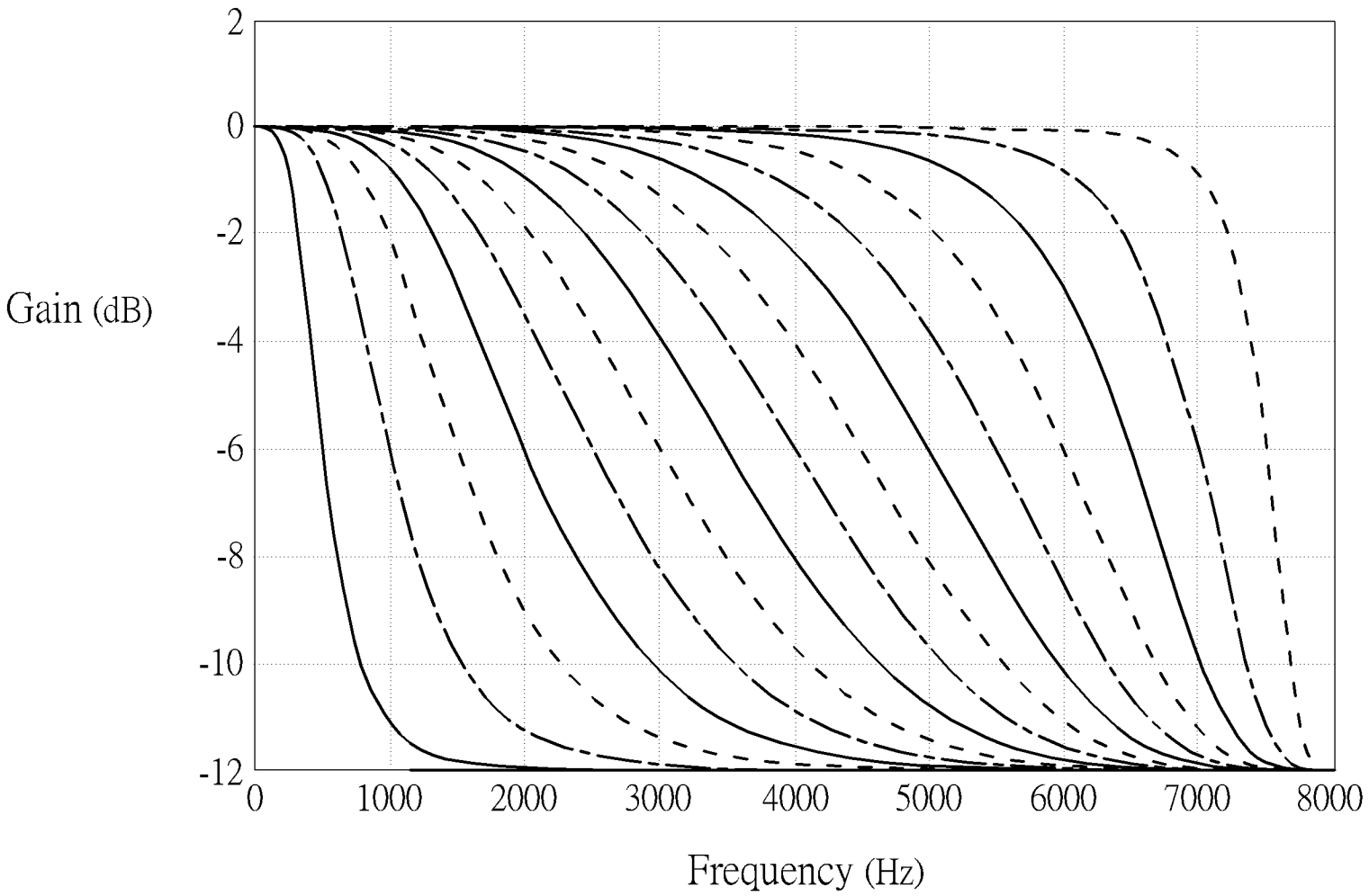
FIG. 4 illustrates frequency responses of filters corresponding to different sets of time-domain filter coefficients according to various embodiments of the present invention.

FIG. 4 illustrates frequency responses of various filters that can be implemented under conditions of cut-off frequency fc=500:500:7500 (Hz), sampling frequency fs=16000 Hz, amplitude A=0.5, quality factor Q=1. Please note that the above-mentioned specific time-domain filter coefficients, such as, cutoff frequency fc, sampling frequency fs, amplitude A, quality factor Q are not limitations of the sets of predetermined filter coefficients in the present invention. According to various embodiments of the present invention, each set of predetermined time-domain filter coefficients may include more different types of coefficients, so as to more finely change and render the characteristics of the time-domain filter 160.

According to a set of time-domain filter coefficients selected by the filter coefficient selection unit 145, the time-domain filter 160 will filter out external environmental noises in the time-domain audio signal x[t] with time-domain processing. As mentioned above, the filter coefficient selection unit 145 selects the time-domain filter coefficient with reference to the noise reduction gain G[f, t] calculated by the noise reduction gain calculation unit 135. When the frequency-domain audio signal X[f, t] changes, the noise reduction gain G[f, t] also changes. Thus, the filter coefficient selection unit 145 will select different time-domain filter coefficients once the signal varies. In one embodiment, in order to avoid popping noise caused by the change of the filter characteristics of the time-domain filter 160 when different time-domain filter coefficients are applied, the audio processing apparatus 100 of the present invention is additionally provided with a filter coefficient interpolation unit 155. Through the filter coefficient interpolation unit 155, the time-domain filter 160 can have a smoother characteristic transition. Assuming that at a current time point, the filter coefficient selection unit 145 has selected the time-domain filter coefficient [B, A], and at the previous time point, the filter coefficient selection unit 145 has selected the time-domain filter coefficient [B', A'] this means that the time-domain filter coefficients of the time-domain filter 160 will be updated from [B', A'] to [B, A]. Thus, the filter coefficient interpolation unit 155 will interpolate multiple sets of time-domain filter coefficients according to the time-domain filter coefficients [B', A'] and [B, A] to implement smooth changes of time-domain filter characteristics. Assuming that the filter coefficient interpolation unit 155 can perform N coefficient updates at N time points, the update time is Nk (where k=0, 1 . . . ), and the time-domain filter coefficients at the time point N(k−1) is [B', A'] while at the time point Nk is [B, A], the time-domain filter coefficients_B use[Nk+n] and A use[Nk+n] at the time point Nk+n (where n=0~N−1) would be:

$$B_\mathrm{use}[Nk+n]=B'+(B-B')*(n/N)$$

$$A_\mathrm{use}[Nk+n]=A'+(A-A')*(n/N)$$

Please note that the time-domain filter coefficients [B, A] mentioned above is not a limitation of the predetermined time-domain filter coefficients in the present invention. That is, the predetermined time-domain filter coefficients in the present invention may comprises more than two sets of coefficients need to be interpolated for smooth transition.

Through the above-mentioned coefficients configuration, the time-domain filter 160 can filter out the noises in the time-domain audio signal x[t], thereby generating a filtered time-domain audio signal y[t]. After filtering, the time-domain audio signal y[t] will be combined with the audio signal z[t] (such as music, voice, etc.) that the user intends to listen to through the summation circuit 170. The result of summation will be converted through the DAC 180 to an analog audio signal. The analog audio signal will be used to drive the speaker unit, which transforms the electronic signal into sound waves for users to listen to.

Figure 5:
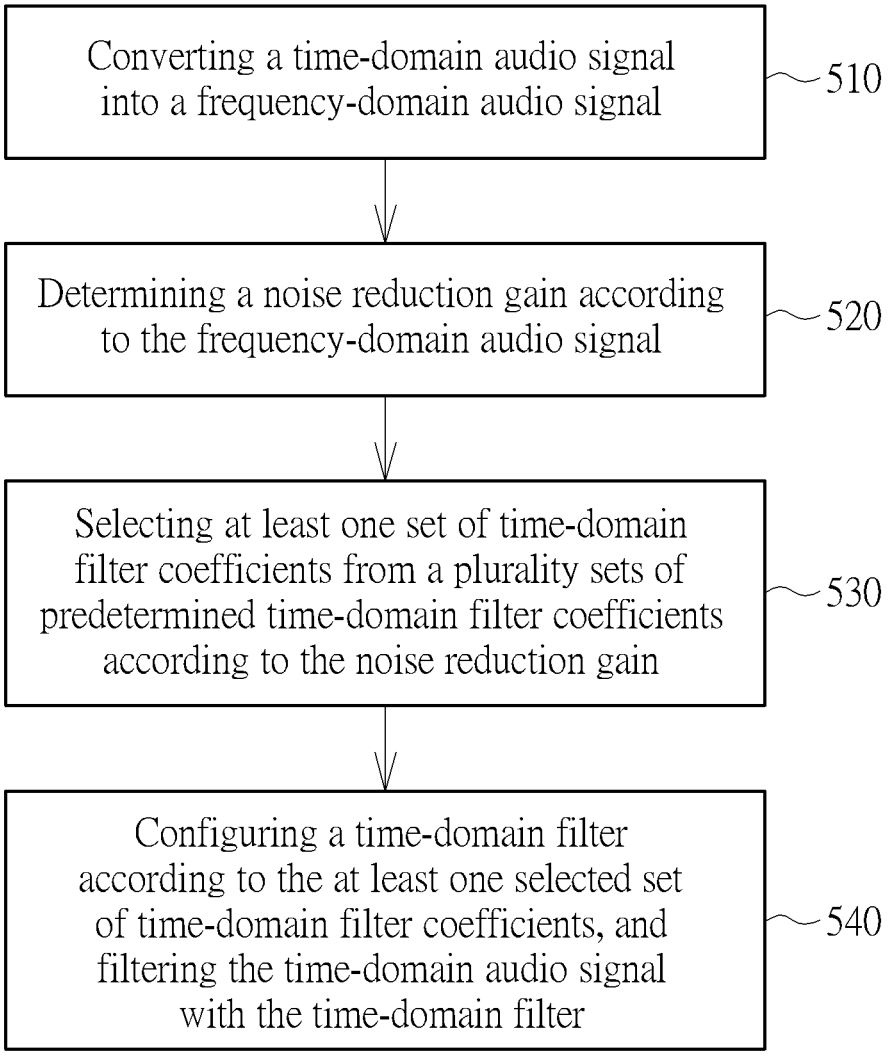
FIG. 5 illustrates a simplified flowchart of an audio processing method according to one embodiment of the present invention.

FIG. 5 illustrates a simplified flowchart of an audio processing method according to one embodiment of the present invention, which including following steps:

Step 510: converting a time-domain audio signal into a frequency-domain audio signal;

Step 520: determining a noise reduction gain according to the frequency-domain audio signal;

Step 530: selecting at least one set of time-domain filter coefficients from a plurality sets of predetermined time-domain filter coefficients according to the noise reduction gain; and Step 540: configuring a time-domain filter according to the at least one selected set of time-domain filter coefficients, and filtering the time-domain audio signal with the time-domain filter.

Since principles and specific details of the foregoing steps have been described and explained in detail with embodiments of the audio processing apparatus 100, further descriptions regarding the audio processing method will not be repeated here. It should be noted that other additional steps may be added into the above flow to render the present invention.

In summary, as the conventional art involves multiple conversions between the time domain and the frequency domain, the latency would be considerably high. On the other hand, the present invention utilizes the time-domain filter and the predetermined time-domain filter coefficients to reduce the time required by conversion between the time domain and the frequency domain. Specifically, the present invention converts the audio signal from the time domain to the frequency domain for noise floor estimation and noise reduction gain calculation. Accordingly, an appropriate set of time-domain filter coefficients is selected from the predetermined time-domain filter coefficients. Noise reduction processing would be performed according to the selected set of time-domain filter coefficients. In addition, in order to avoid possible popping noise when the filter coefficients are changed, the present invention also utilizes interpolation to allow the filter characteristics to change smoothly. In view of above, the present invention avoids the occurrence of echo by reducing the latency, thereby ensuring a natural sense of hearing of audio pass-through as well as a decent noise reduction effect.

Embodiments in accordance with the present invention can be implemented as an apparatus, method, or computer program product. Accordingly, the present embodiments may take the form of an entirely hardware embodiment, an entirely software embodiment, or an embodiment combining software and hardware aspects that can all generally be referred to herein as a "module" or "system." Furthermore, the present embodiments may take the form of a computer program product embodied in any tangible medium of expression having computer-usable program code embodied in the medium. In terms of hardware, the present invention can be accomplished by applying any of the following technologies or related combinations: an individual operation logic with logic gates capable of performing logic functions according to data signals, and an application specific integrated circuit (ASIC), a programmable gate array (PGA) or a field programmable gate array (FPGA) with a suitable combinational logic.

The flowchart and block diagrams in the flow diagrams illustrate the architecture, functionality, and operation of possible implementations of systems, methods, and computer program products according to various embodiments of the present embodiments. In this regard, each block in the flowchart or block diagrams may represent a module, segment, or portion of code, which comprises one or more executable instructions for implementing the specified logical function(s). It is also noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions. These computer program instructions can be stored in a computer-readable medium that directs a computer or other programmable data processing apparatus to function in a particular manner, such that the instructions stored in the computer-readable medium produce an article of manufacture including instruction means which implement the function/act specified in the flowchart and/or block diagram block or blocks.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An audio processing method, comprising:

converting a time-domain audio signal into a frequency-domain audio signal;

determining a noise reduction gain according to the frequency-domain audio signal;

selecting a set of time-domain filter coefficients from a plurality sets of predetermined time-domain filter coefficients according to the noise reduction gain, comprising:

determining a maximum frequency from a plurality of frequency-domain audio signals that are converted from a plurality of time-domain audio signals according to a frequency that allows the noise reduction gain to be greater than a predetermined threshold; and selecting the set of time-domain filter coefficients from the plurality sets of predetermined time-domain filter coefficients according to the maximum frequency, wherein the plurality set of predetermined time-domain filter coefficients have cut-off frequencies; and among the plurality sets of predetermined time-domain filter coefficients, the selected set of time-domain filter coefficients has a cut-off frequency that is closest to the maximum frequency; and configuring a time-domain filter according to the selected set of time-domain filter coefficients, and filtering the time-domain audio signal with the time-domain filter.

2. The audio processing method of claim 1, wherein the step of determining the noise reduction gain according to the frequency-domain audio signal comprises:

estimating a noise floor of the frequency-domain audio signal; and calculating the noise reduction gain according to the noise floor.

3. The audio processing method of claim 1, wherein the step of converting the time-domain audio signal into the frequency-domain audio signal comprises:

perform a short-time Fourier transform (STFT) on the time-domain audio signal to obtain the frequency-domain audio signal.

4. The audio processing method of claim 1, wherein the step of selecting the set of time domain filter coefficients according to the maximum frequency comprises:

performing a frequency averaging calculation or a frequency shifting calculation according to the maximum frequency to obtain an adjusted maximum frequency; and selecting the set of time-domain filter coefficients from the plurality sets of predetermined time-domain filter coefficients according to the adjusted maximum frequency.

5. The audio processing method of claim 1, further comprising:

according to a first set of time-domain filter coefficients selected from the plurality sets of predetermined time-domain filter coefficients at a first time point and a second set of time-domain filter coefficients selected from the plurality sets of predetermined time-domain filter coefficients at a second time point, obtaining one or more third sets of time-domain filter coefficients by interpolation; and during a period of time, configuring the time-domain filter sequentially according to the first set of time-domain filter coefficients, the one or more third sets of time-domain filter coefficients, and the second set of time-domain filter coefficients.

6. The audio processing method of claim 1, wherein the plurality sets of predetermined time-domain filter coefficients can configure the time-domain filter as a high-shelving filter, a low-shelving filter, or a band-pass filter.

7. An audio processing apparatus, comprising:

a Fourier transform circuit, arranged to convert a time-domain audio signal into a frequency-domain audio signal;

a noise analysis circuit, coupled to the Fourier transform circuit, arranged to determine a noise reduction gain according to the frequency-domain audio signal;

a filter coefficient storage circuit, arranged to store a plurality set of predetermined time-domain filter coefficients;

a filter coefficient selection circuit, coupled to the noise analysis circuit and the filter coefficient storage circuit, arranged to select a set of time-domain filter coefficients from the plurality sets of predetermined time-domain filter coefficients according to the noise reduction gain;

a frequency determination circuit, coupled to the noise reduction gain calculation circuit, arranged to determine a maximum frequency from a plurality of frequency-domain audio signals that are converted from a plurality of time-domain audio signals according to a frequency that allows the noise reduction gain to be greater than a predetermined threshold, wherein the filter coefficient selection circuit is arranged to select the set of time-domain filter coefficients from the plurality sets of predetermined time-domain filter coefficients according to the maximum frequency, and the plurality set of predetermined time-domain filter coefficients have cut-off frequencies; among the plurality sets of predetermined time-domain filter coefficients, the selected set of time-domain filter coefficients has a cut-off frequency that is closest to the maximum frequency; and a time-domain filter, coupled to the filter coefficient selection circuit, controllable by the selected set of time-domain filter coefficients, and arranged to filter the time-domain audio signal.

8. The audio processing apparatus of claim 7, wherein the noise analysis circuit comprises:

a noise floor estimation circuit, coupled to the Fourier transform circuit, arranged to estimating a noise floor of the frequency-domain audio signal; and a noise reduction gain calculation unit, coupled to the noise floor estimation circuit, arranged to calculate the noise reduction gain according to the noise floor.

9. The audio processing apparatus of claim 7, wherein the Fourier transform circuit is arranged to perform a short-time Fourier transform (STFT) on the time-domain audio signal to obtain the frequency-domain audio signal.

10. The audio processing apparatus of claim 7, wherein the frequency determination circuit is arranged to perform a frequency averaging calculation or a frequency shifting calculation according to the maximum frequency to obtain an adjusted maximum frequency, wherein the filter coefficient selection circuit is arranged to select the set of time-domain filter coefficients from the plurality sets of predetermined time-domain filter coefficients according to the adjusted maximum frequency.

11. The audio processing apparatus of claim 7, further comprising:

a filter coefficient interpolation circuit, coupled to the filter coefficient selection circuit, arranged to obtain one or more third sets of time-domain filter coefficients by interpolation according to a first set of time-domain filter coefficients selected from the plurality sets of predetermined time-domain filter coefficients at a first time point and a second set of time-domain filter coefficients selected from the plurality sets of predetermined time-domain filter coefficients;

wherein the time-domain filter is configured sequentially according to the first set of time-domain filter coefficients, the one or more sets of third set of time-domain filter coefficients, and the second set of time-domain filter coefficients during a period of time.

12. The audio processing apparatus of claim 7, wherein the plurality sets of predetermined time-domain filter coefficients can configure the time-domain filter as a high-shelving filter, a low-shelving filter, or a band-pass filter.

* * * * *